US007172725B2

(12) United States Patent
Hong et al.

(10) Patent No.: US 7,172,725 B2
(45) Date of Patent: Feb. 6, 2007

(54) W-CU ALLOY HAVING HOMOGENEOUS MICRO-STRUCTURE AND THE MANUFACTURING METHOD THEREOF

(75) Inventors: Moon-Hee Hong, Seoul (KR); Ja-Ho Choi, Daejeon (KR); Seoung Lee, Daejeon (KR); Eun-Pyo Kim, Daejeon (KR); Sung-Ho Lee, Daejeon (KR); Joon-Woong Noh, Daejeon (KR)

(73) Assignee: Agency For Defense Development, Daejeon (KR)

( * ) Notice: Subject to any disclaimer, the term of this patent is extended or adjusted under 35 U.S.C. 154(b) by 37 days.

(21) Appl. No.: 10/724,381

(22) Filed: Nov. 28, 2003

(65) Prior Publication Data

US 2004/0120840 A1 Jun. 24, 2004

(30) Foreign Application Priority Data

Nov. 29, 2002 (KR) ..... 10-2002-0075491

(51) Int. Cl.
*B22F 3/26* (2006.01)
*B22F 3/16* (2006.01)
*B22F 1/02* (2006.01)

(52) U.S. Cl. ..... 419/27; 419/31; 419/34; 419/35; 419/38; 419/58

(58) Field of Classification Search ..... 419/27, 419/32, 47, 31, 34, 35, 38, 58
See application file for complete search history.

(56) References Cited

U.S. PATENT DOCUMENTS 3,382,066 A * 5/1968 Kenney et al. ..... 419/19
3,440,043 A * 4/1969 Krock et al. ..... 419/27
3,467,517 A * 9/1969 Krock et al. ..... 419/39
3,489,530 A * 1/1970 Schreiner ..... 428/569
5,439,638 A * 8/1995 Houck et al. ..... 419/30
5,470,549 A * 11/1995 Dorfman et al. ..... 423/61
5,686,676 A * 11/1997 Jech et al. ..... 75/247
5,842,108 A * 11/1998 Kim et al. ..... 419/33
5,963,773 A * 10/1999 Yoo et al. ..... 419/27
6,103,392 A * 8/2000 Dorfman et al. ..... 428/570
6,271,585 B1 * 8/2001 Osada et al. ..... 257/712
6,375,708 B1 * 4/2002 Dorfman et al. ..... 75/248
6,693,353 B1 * 2/2004 Hirayama et al. ..... 257/746
2003/0124016 A1 * 7/2003 Kim et al. ..... 419/34

FOREIGN PATENT DOCUMENTS

JP 44-19016 8/1969

(Continued)

*Primary Examiner*—Roy King
*Assistant Examiner*—Michael P. Alexander
(74) *Attorney, Agent, or Firm*—Scully, Scott, Murphy & Presser, P.C.

(57) ABSTRACT

In W—Cu alloy having a homogeneous micro-structure and a fabrication method thereof, the method includes forming mixed powders by mixing tungsten powders with W—Cu composite powders; forming a compact by pressurizing-forming the mixed powders; forming a skeleton by sintering the compact; and contacting copper to the skeleton and performing infiltration. W—Cu alloy having a homogeneous structure fabricated by the present invention shows better performance by being used as a material for high voltage electric contact of a contact braker, a material for heat sink of an IC semiconductor and a shaped charge liner.

5 Claims, 6 Drawing Sheets

FOREIGN PATENT DOCUMENTS

| | | | |
|---|---|---|---|
| JP | 03-120324 | | 5/1991 |
| JP | 403162504 A | * | 7/1991 |
| JP | 04-049642 | | 2/1992 |
| KR | 0127652 | | 1/1996 |
| KR | 24857/2002 | | 11/2003 |

* cited by examiner

W-CU ALLOY HAVING HOMOGENEOUS MICRO-STRUCTURE AND THE MANUFACTURING METHOD THEREOF

BACKGROUND OF THE INVENTION

1. Field of the Invention

The present invention relates to W—Cu alloy having a homogeneous micro-structure.

2. Description of the Related Art

Because W—Cu alloy has high electric arc resistance, good thermal conductivity, good electric conductivity and thermal expansion coefficient similar to that of Si used for a semiconductor, it is widely used as a material for high voltage electric contact of a contact braker and a material for heat sink of an IC semiconductor. In addition, because W—Cu alloy has high density and great ductility at a high strain rate, it is spotlighted as a material for a military shaped charge liner.

In a method for fabricating W—Cu alloy in accordance with the conventional art, a method for mixing tungsten powders with copper powders, forming the mixture, sintering it to obtain a skeleton and infiltrating copper was disclosed in Korean Patent No. 0127652. However, in the conventional method, as indicated by arrows in FIG. 1, early mixed copper powders are moved into a space among adjacent tungsten powders by a capillary force in sintering process, permeated copper substitute for tungsten, and accordingly W—Cu alloy having a heterogeneous micro-structure (copper rich region) may be fabricated. When W—Cu alloy having a heterogeneous micro-structure is used as a material for high voltage electric contact of a contact braker and a material for heat sink of an IC semiconductor, crack may occur due to abnormal arc generation or partial thermal expansion coefficient difference, and accordingly life-span of a material for high voltage electric contact of a contact braker and a material for heat sink of an IC semiconductor may be greatly reduced.

When, W—Cu alloy having a heterogeneous micro-structure is used for a military shaped charge liner, the heterogeneous micro-structure may be an immediate cause of anisotropic metal jet occurrence when the liner collapses by explosion of explosive. The anisotropy of metal jet may greatly reduce a penetrating force of a shaped charge liner, and accordingly W—Cu alloy fabricated by the conventional method is inappropriate for a shaped charge liner In order to solve the above-mentioned problem, applicants of the present invention have developed a method for fabricating W—Cu alloy having a homogeneous micro-structure by using tungsten and W—Cu composite powders (in accordance with Korean Patent No. 248S7/2002 instead of tungsten and copper powders). As depicted in FIG. 2, W—Cu alloy fabricated by that method does not have a heterogeneous structure such as a copper rich region, it can show better performance by being used as a material for high voltage electric contact of a contact braker, a material for heat sink of an IC semiconductor and a material for a shaped charge liner in comparison with W—Cu alloy fabricated by the conventional method.

SUMMARY OF THE INVENTION

In order to solve the above-mentioned problem, it is an object of the present invention to provide W—Cu alloy having a homogeneous micro-structure by using mixed powders of tungsten powders and W—Cu composite powders (obtained by Korean Patent No. 24857/2002 instead of mixed powders of tungsten powders and copper powders).

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
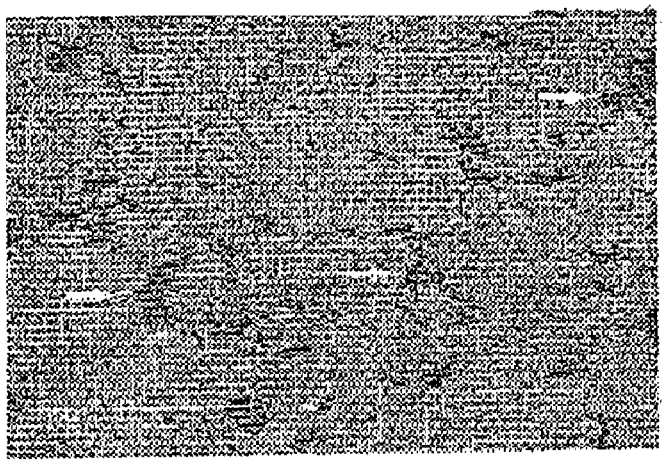
FIG. 1 is a photograph taken with a SEM (scanning electron microscope) showing a micro-structure of W—Cu alloy fabricated in accordance with the conventional method.

In order to achieve the above-mentioned object, a method for fabricating W—Cu alloy having a homogeneous structure including forming mixed powders by mixing tungsten powders with W—Cu composite powders; forming a compact by pressurizing-forming the mixed powders; forming a skeleton by sintering the compact; and infiltrating the skeleton by contacting it with copper will be described.

The mixed powders forming step will be described in more detail. First, tungsten powders and W—Cu composite powders having a particle size of 1 μm–40 μm are weighed so as to have an expected tungsten: copper ratio by weight, and the weighed tungsten and W—Cu composite powders are homogeneously mixed by a turbular mixing method or a ball milling method.

The W—Cu composite powders are obtained by a method disclosed in Korean Patent No. 24857 (May 6, 2002). In the method, by mixing tungsten oxide ($WO_3$ and $WO_{2.9}$) powders with copper oxide (CuO and $Cu_2O$) powders, milling the mixture and performing reduction heat processing, homogeneous round-shaped W—Cu composite powders in which a tungsten powder covers a copper powder are obtained.

The composite powders obtaining method will be described in more detail. In the method, tungsten and copper powders are weighed so as to be a certain ratio, the powders are homogeneously mixed by a turbular mixing method or a ball milling method, the mixture is heated for 1 minute–5 hours at a temperature range within 200° C.–400° C. in a reduction atmosphere as a first step, it is heated for 1 minute–5 hours at a temperature range within 500° C.–700° C. in a reduction atmosphere as a second step, and it is heated for 1 minute–5 hours at a temperature range within 750° C.–1080° C. in a reduction atmosphere as a third step Because the W—Cu composite powders fabricated by the method have a structure in which a tungsten powder covers a copper powder, there is no generation of intermediate or contamination of impurities. Because the W—Cu composite powders have an appropriate size and a round shape, flow characteristic of powders can be improved, and the ability for powder injection molding can be improved.

It is preferable for the mixture of tungsten powders and W—Cu composite powders to have a tungsten: copper ratio by weight as 20:1 or 2:1. When a tungsten: copper ratio by weight is not less than 20:1, because a quantity of added copper is too little, tungsten grains can not have sufficient strength with the added copper, and a function for smoothing a capillary in a skeleton can not be performed. In addition, when a tungsten:copper ratio by weight is not greater than 2:1, there is too many copper, shape slumping may cause in sintering for making a skeleton. It is more preferable to have a tungsten:copper ratio by weight within the range of 12:1–8:1.

Next, a step for forming a compact will be described. After putting the mixture of tungsten powders and W—Cu powders into a mold having an expected shape, it is pressurized with pressure of approximately 100 MPa, and accordingly a compact is obtained. In order to prevent contamination of impurities, it is preferable to fabricate the mixture without adding other materials. As occasion demands, binder such as stearic acid or paraffin wax can be used in order to increase formability of the mixture.

Next, a step for forming a skeleton by sintering the compact will be performed. By heating the obtained compact at a temperature not less than a melting temperature of copper in a hydrogen or dissociated ammonia gas atmosphere and cooling the compact, a skeleton is obtained. In that case, copper in the W—Cu composite powders is melted and is moved into a space among the adjacent tungsten powders by a capillary force. In addition, it is possible to handle the copper placed among the tungsten grains by giving strength to the skeleton, and accordingly copper can easily impregnate through the skeleton in a following infiltration method. In the meantime, after copper is melted and moves out, because tungsten included in the W—Cu composite powders remains as it is and is solid phase-sintered with adjacent tungsten powders, it contributes to forming of a skeleton. In addition, because it is combined with copper infiltrated in a following process, it is possible to prevent generation of a copper rich region.

It is preferable to perform sintering of the compact at a temperature not less than 1083° C. as a melting temperature of copper in a reduction gas atmosphere including hydrogen. When a sintering temperature is lower than 1083° C., melting of copper can not occur, copper can not permeate through the tungsten grains to maintain strength of the skeleton and smooth the capillary.

Next, a step for contacting copper to the skeleton and infiltrating it will be described. The infiltrating step is performed by contacting copper to the skeleton obtained through the above-described steps and maintaining it at a high temperature for a certain time in a hydrogen or dissociated ammonia gas atmosphere. It is preferable to perform the infiltration at a temperature not less than 1083° C. as a melting temperature of copper.

Figure 2:
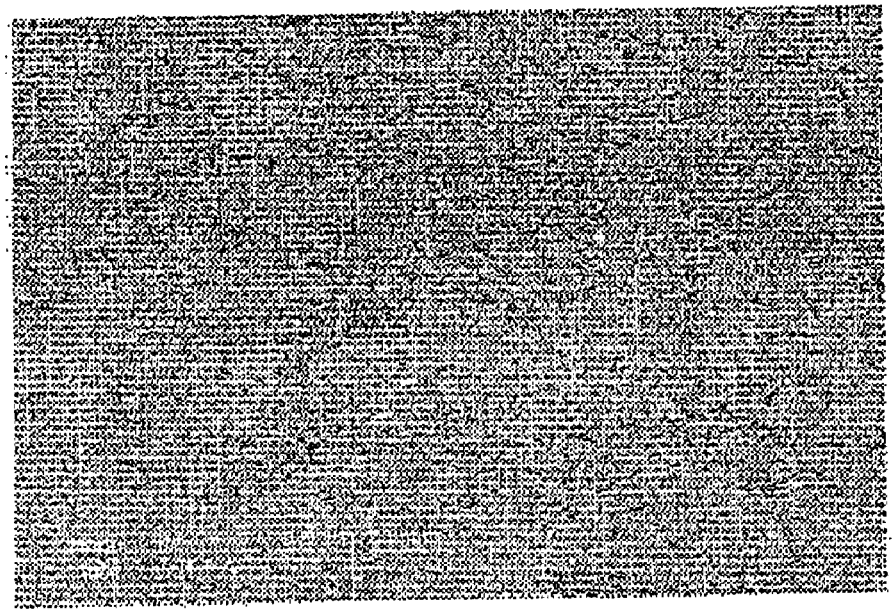
FIG. 2 is a photograph taken with a SEM (scanning electron microscope) showing a micro-structure of W—Cu alloy having a homogeneous structure without a copper rich region fabricated in accordance with the present invention.

FIG. 2 is a photograph taken with a SEM (scanning electron microscope) showing a micro-structure of W—Cu alloy having a homogeneous structure without a copper rich region fabricated in accordance with the present invention. As depicted in FIG. 2, it can be known the W—Cu alloy fabricated in the present invention has a homogeneous micro-structure without a copper rich region.

Hereinafter, the preferred embodiments of the present invention will be described with reference to accompanying drawings. As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

EXAMPLE 1

Tungsten (W) powders having a particle size of 2.5 μm and W—Cu composite powders (fabricated by Korean Patent No. 24857) having a particle size of approximately 1–2 μm are weighed so as to have a tungsten:copper ratio by weight as 12:1 and are mixed by using a turbular mixer for 6 hours.

The mixed powders are put into a metal mold having a size of 40 mm (W)×10 mm (L)×10 mm (H), uniaxial compression is performed with pressure of 100 MPa, and accordingly a compact is obtained.

Figure 3:
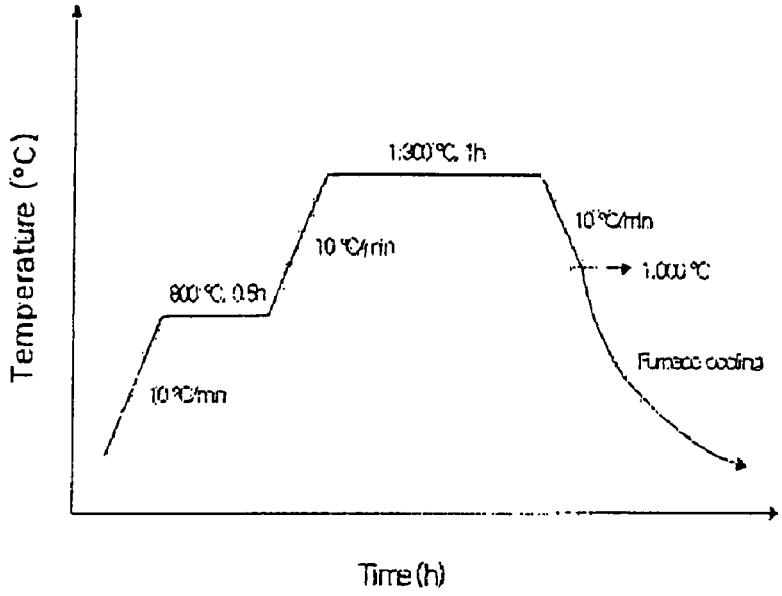
FIG. 3 is a graph showing a process for forming a skeleton by sintering a compact in accordance with the present invention.
Figure 4:
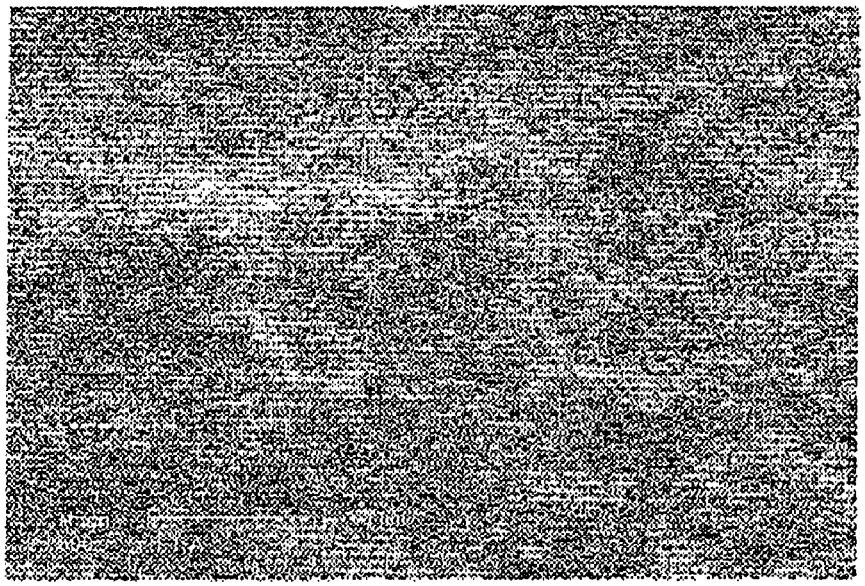
FIG. 4 is a photograph taken with a SEM (scanning electron microscope) showing a fractured surface of the skeleton fabricated in accordance with the present invention.
Figure 5:
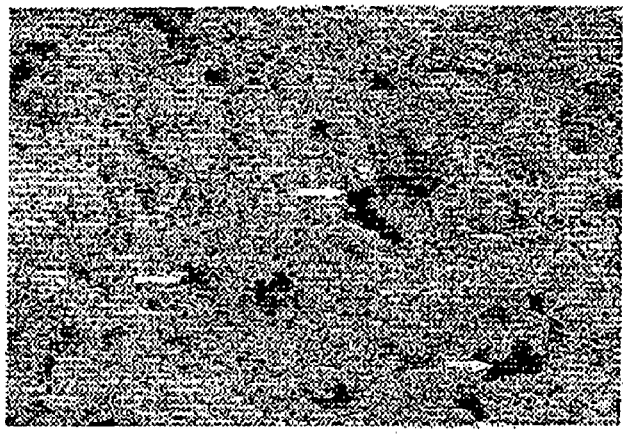
FIG. 5 is a photograph taken with a SEM (scanning electron microscope) showing a fractured surface of a skeleton fabricated in accordance with the conventional method.

In a dry hydrogen atmosphere having a dew point temperature of −60° C., as depicted in FIG. 3, a temperature of the compact rises to 800° C. at a heating rate of 10° C. per minute, by maintaining the temperature for 30 minutes, oxide on the surface of powders is eliminated. Afterward, a temperature rises again to 1300° C., by maintaining the temperature for an hour, a skeleton for infiltrating copper is obtained. FIG. 4 is a photograph taken with a SEM (scanning electron microscope) showing a fractured surface of the skeleton fabricated by the method. FIG. 5 is a photograph taken with a SEM (scanning electron microscope) showing a fractured surface of a skeleton fabricated by the conventional method so as to have the same tungsten:copper composition ratio with the present invention. In comparing of FIG. 4 with FIG. 5, in the skeleton fabricated by the conventional method, as indicated by arrows in FIG. 5, there are many pores generated by copper permeating through adjacent tungsten powders by a capillary force. Unlike the conventional method, the skeleton fabricated by the present invention has a homogeneous structure without many pores.

Figure 6:
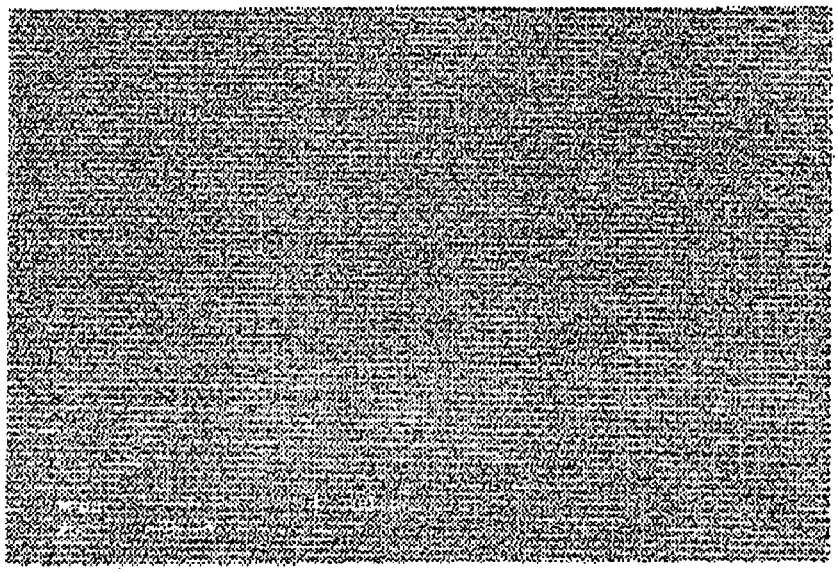
FIG. 6 is a photograph taken with a SEM (scanning electron microscope) showing a microstructure of W—Cu alloy fabricated in accordance with the present invention.

Next, after contacting the skeleton to copper, in a dry hydrogen atmosphere having a dew point temperature of −60° C., by performing infiltration process for rising a temperature of the skeleton to 1250° C. at a heating rate of 10° C. per minute and maintaining it for an hour, W—Cu alloy is fabricated. For comparison, by infiltrating the skeleton fabricated by the conventional method by using the same method, W—Cu alloy is obtained. FIG. 6 is a photograph taken with a SEM (scanning electron microscope) showing a micro-structure of W—Cu alloy fabricated in accordance with the present invention, and FIG. 7 is a photograph taken with a SEM (scanning electron microscope) showing a micro-structure of W—Cu alloy fabricated in accordance with the conventional method.

Figure 7:
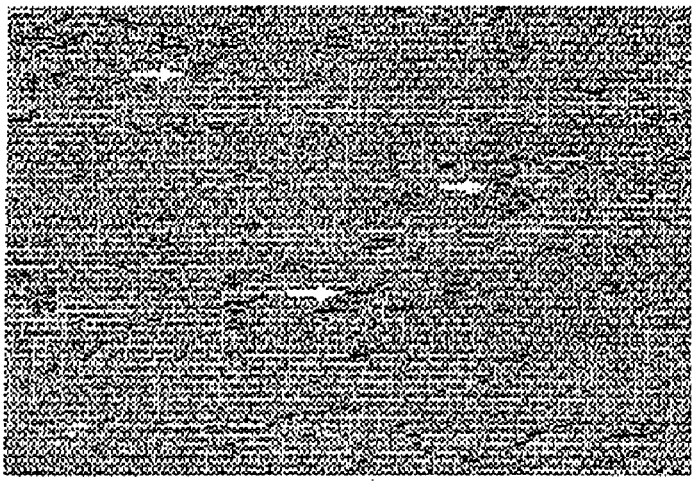
FIG. 7 is a photograph taken with a SEM (scanning electron microscope) showing a micro-structure of W—Cu alloy fabricated in accordance with the conventional method.

As depicted in FIG. 7, in the W—Cu alloy fabricated by the conventional method, a copper rich region (Cu pool) indicated by arrows is observed. On the contrary, in the W—Cu alloy in accordance with the present invention, there is no copper rich region, and a homogeneous structure is observed.

EXAMPLE 2

Figure 8:
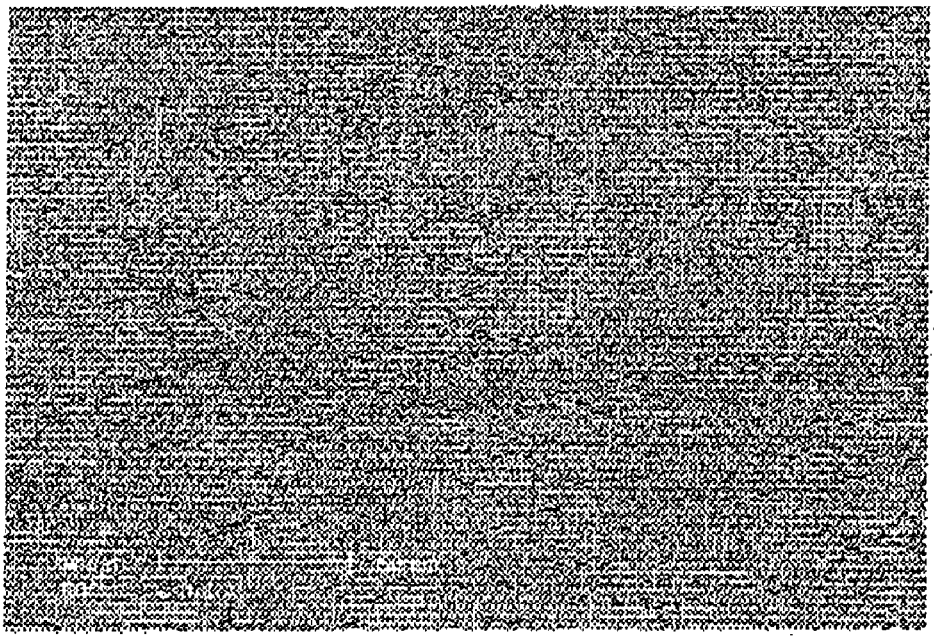
FIG. 8 is a photograph taken with a SEM (scanning electron microscope) showing a micro-structure of W—Cu alloy fabricated according to a tungsten copper ratio by weight as 8:1 in accordance with the present invention.

In order to observe variation of a micro-structure of W—Cu alloy according to chemical composition, by varying a tungsten:copper ratio by weight as 8:1, W—Cu alloy is fabricated by the same method with Example 1. FIG. 8 is a photograph taken with a SEM (scanning electron microscope) showing a micro-structure of W—Cu alloy fabricated according to a tungsten:copper ratio by weight as 8:1 in accordance with the present invention. It shows W—CU alloy has a homogeneous structure without a copper rich region.

It means W—CU alloy fabricated by the present invention has a homogeneous structure regardless of a tungsten:copper ratio by weight.

EXAMPLE 3

Figure 9:
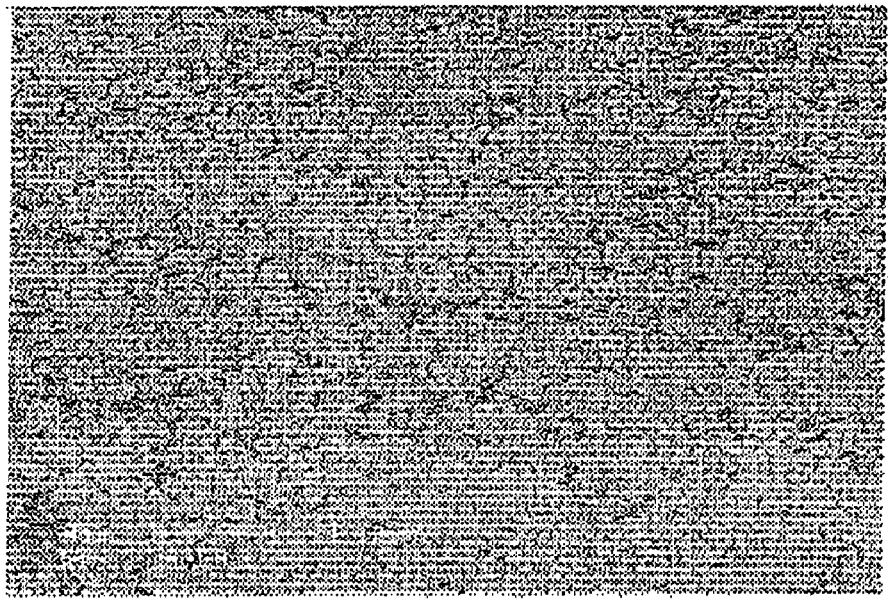
FIG. 9 is a photograph taken with a SEM (scanning electron microscope) showing a micro-structure of W—Cu alloy fabricated by using tungsten powders having an average particular size of 4.5 μm in accordance with the present is invention.

In order to observe variation of a micro-structure of W—Cu alloy according to tungsten particle, by varying only a particle size of tungsten powder as 4.5 μm, W—Cu alloy is fabricated by the same method with Example 1. FIG. 9 is a photograph taken with a SEM (scanning electron microscope) showing a micro-structure of W—Cu alloy fabricated by that method. A particular size of tungsten is increased, however, alike the micro-structure of W—Cu alloy fabricated by using tungsten powders having a size of 2.5 μm (shown in FIG. 6), W—CU alloy having a homogeneous structure without a copper rich region is obtained.

Figure 10:
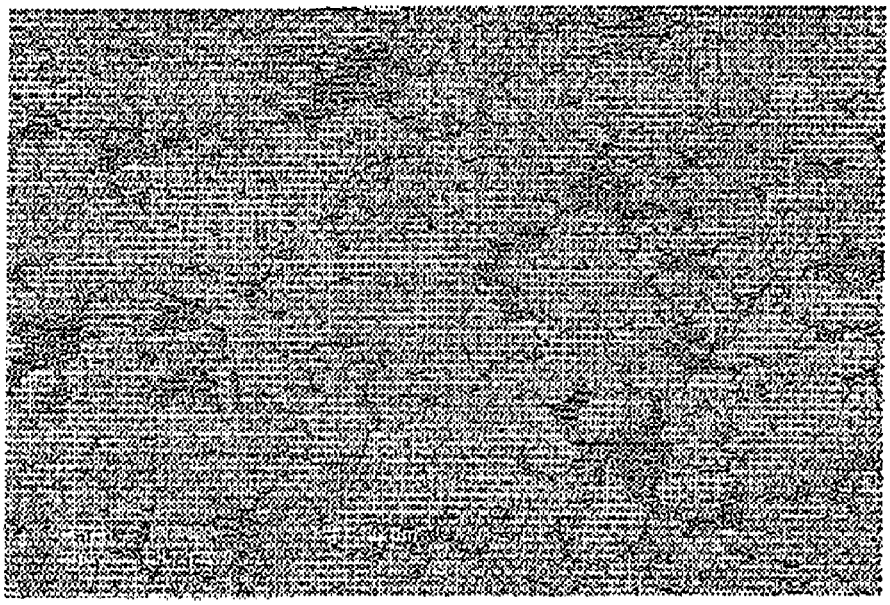
FIG. 10 is a photograph taken with a SEM (scanning electron microscope) showing a micro-structure of W—Cu alloy fabricated by using tungsten powders having an average particular size of 4.5 μm in accordance with the conventional method.

In the meantime, for comparing, W—Cu alloy is fabricated by the conventional method with powders having a particular size of 4.5 μm, FIG. 10 shows a micro-structure thereof. As depicted in FIG. 10, the W—Cu alloy fabricated by the conventional method includes a heterogeneous copper rich region.

However, W—Cu alloy fabricated by the present invention has a homogeneous structure regardless of a size of tungsten powders.

EXAMPLE 4

Figure 11:
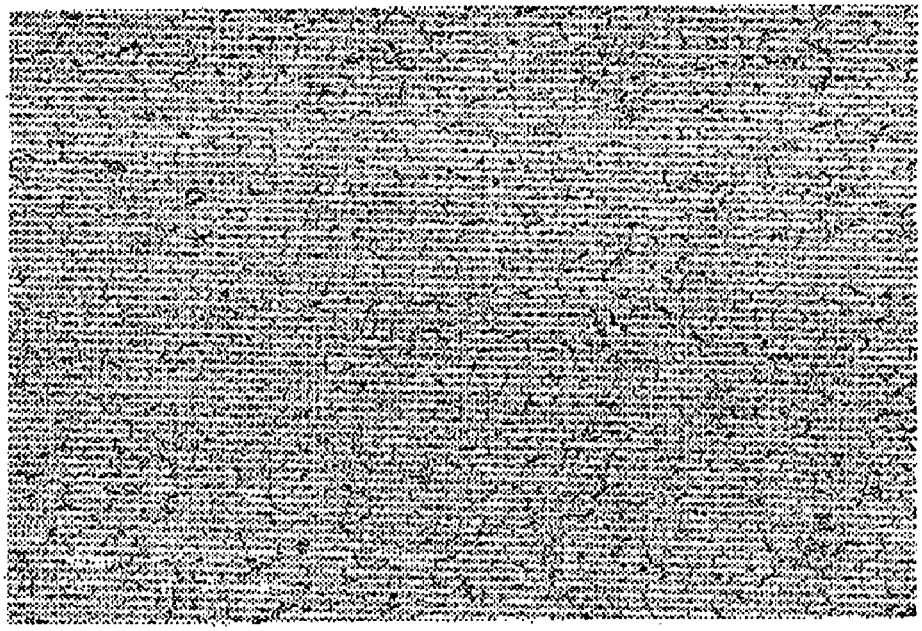
FIG. 11 is a photograph taken with a SEM (scanning electron microscope) showing a micro-structure of W—Cu alloy fabricated by infiltrating copper at 1400° C. in accordance with the present invention.

In order to observe variation of a micro-structure of W—Cu alloy according to an infiltrating temperature, by performing infiltration at 1400° C. for an hour, W—Cu alloy is fabricated by the same method with Example 1, and FIG. 11 shows a micro-structure thereof. As depicted in FIG. 11, according to infiltration temperature rising, growth of tungsten particle occurs, however, even in that case, W—Cu alloy has a homogeneous structure without a copper rich region.

It means W—Cu alloy fabricated by the present invention has a homogeneous structure at a temperature not less than 1083° C. as a copper melting temperature regardless of an infiltration temperature.

As described-above, in the method for fabricating W—Cu alloy in accordance with the present invention, although copper included in W—Cu composite powders permeates through tungsten powders in a sintering process, tungsten included in the W—Cu composite powders remains at an initial position, and accordingly W—Cu alloy having a homogeneous structure without a copper rich region can be fabricated after infiltration.

In addition, W—Cu alloy having a homogeneous structure fabricated by the present method shows better performance as a material for high voltage electric contact of a contact braker, a material for heat sink of an IC semiconductor and a shaped charge liner.

What is claimed is:

1. A method for fabricating W—Cu alloy having a homogenous micro-structure, comprising:

forming mixed powders by mixing tungsten powders with W—Cu composite powders;

forming a compact by pressurizing-forming the mixed powders;

forming a skeleton by sintering the compact; and contacting copper to the skeleton and performing infiltration.

2. The method of claim 1, wherein the W—Cu composite powders are obtained by (a) mixing together a powder comprised of a mixture of $WO_3$ and $WO_2$ with a copper oxide powder comprised of a mixture of CuO and $Cu_2O$; (b) milling the product of step (a) and (c) performing reduction heat treatment on the product of (b) to form said W—Cu-composite powder in which the tungsten powder covers the copper powder.

3. The method of claim 1, wherein the mixture of tungsten powders and W—Cu composite powders has a tungsten: copper ratio by weight as 20:1 or 2:1.

4. The method of claim 1, wherein sintering of the compact is performed at a temperature not less than 1083° C. as a melting temperature of copper in a reduction gas atmosphere including hydrogen.

5. The method of claim 1, wherein infiltration of copper is performed at a temperature not less than 1083° C. as a melting temperature of copper in a reduction gas atmosphere including hydrogen.

* * * * *